US007707671B2

(12) United States Patent
Koo

(10) Patent No.: US 7,707,671 B2
(45) Date of Patent: May 4, 2010

(54) DEHYDRATION CONTROLLING APPARATUS FOR WASHING MACHINE AND METHOD THEREOF

(75) Inventor: Bon-Kwon Koo, Seongdong-Gu (KR)

(73) Assignee: LG Electronics Inc., Seoul (KR)

( * ) Notice: Subject to any disclaimer, the term of this patent is extended or adjusted under 35 U.S.C. 154(b) by 904 days.

(21) Appl. No.: 11/516,779

(22) Filed: Sep. 7, 2006

(65) Prior Publication Data

US 2007/0050920 A1 Mar. 8, 2007

(30) Foreign Application Priority Data

Sep. 7, 2005 (KR) ..... 10-2005-0083378

(51) Int. Cl.
*D06F 33/02* (2006.01)

(52) U.S. Cl. ..... 8/158; 68/24; 68/140

(58) Field of Classification Search ..... 68/24, 68/140; 8/159

See application file for complete search history.

(56) References Cited

U.S. PATENT DOCUMENTS 2,892,334 A * 6/1959 Gray Jr. ..... 68/12.15
4,513,464 A * 4/1985 Rettich et al. ..... 8/159
4,782,544 A * 11/1988 Nystuen et al. ..... 8/159
5,075,613 A * 12/1991 Fisher ..... 318/809
5,930,855 A * 8/1999 Vande Haar et al. ..... 8/159
6,023,854 A * 2/2000 Tsunomoto et al. ..... 34/531
7,530,133 B2 * 5/2009 Mitts ..... 8/159
2004/0098813 A1 5/2004 Son
2005/0016227 A1 1/2005 Lee
2006/0010614 A1 1/2006 Yim et al.

FOREIGN PATENT DOCUMENTS

DE 39 11 124 * 10/1990
DE 41 15 776 * 11/1992
EP 0302319 2/1989
EP 1693498 A2 8/2006
FR 2630137 A 10/1989

OTHER PUBLICATIONS

European Patent Office 0 071 308 Feb. 1983.*

* cited by examiner

*Primary Examiner*—Frankie L Stinson
(74) *Attorney, Agent, or Firm*—McKenna Long & Aldridge LLP

(57) ABSTRACT

A spin cycle controlling apparatus for a washing machine includes a storage unit in which an acceleration rate, an allowable maximum unbalance amount and an allowable minimum unbalance amount according to an amount of laundry are pre-stored; and a controlling unit for repeatedly controlling an operation of increasing and decreasing revolutions per minute (RPM) in a region between the allowable maximum unbalance amount and the allowable minimum unbalance amount until an unbalance amount detected is less than the allowable minimum unbalance amount.

16 Claims, 5 Drawing Sheets

DEHYDRATION CONTROLLING APPARATUS FOR WASHING MACHINE AND METHOD THEREOF

The application claims the benefit of Korean Application No. 10-2005-0083378, filed on Sep. 7, 2005, which is herein incorporated by reference for all purposes as if fully set forth herein.

BACKGROUND OF THE INVENTION

Field of the Invention

The present invention relates to a washing machine, and particularly, to a dehydration controlling apparatus for a washing machine and a method thereof capable of stabilizing unbalanced laundry loads.

In general, a washing machine washes laundry (i.e., removing contaminants such as dirt, oil, stains, or the like from the laundry) by mechanically applying a suitable friction or vibration to the laundry in a laundry detergent.

For this purpose, the washing machine has a washing cycle for applying a mechanical force to the laundry in water mixed with the detergent, a rinsing cycle for rinsing the detergent containing the contaminant out of the laundry, and a spin cycle for removing the rinsed water from the laundry.

During the spin cycle, the laundry may become unbalanced due to unevenly-distributed laundry contained in the washing machine that causes severe vibration and noise.

Accordingly, a laundry balancing function is required for the washing machine thus to detect an UnBalance (UB) amount and then evenly distribute the laundry according to the detected UB amount.

FIG. 1 is a flowchart illustrating operations related to UB amount detecting and spinning method of a washing machine according to the related art.

As illustrated in FIG. 1, a UB amount detecting and spinning method of a washing machine includes driving a washing machine in a low speed manner (S11), sensing a change in a motor speed (i.e., Rotation Per Minute: RPM) of the washing machine according to changes in time to thereby detect an UB amount (S12), comparing the detected UB amount to a preset reference UB amount (S13), and performing a laundry balancing function when the detected UB amount is greater than the reference UB amount, and spinning the laundry by increasing the RPM of the washing machine when the detected UB amount is less than the reference UB amount (S14A and S14B).

The detection of the UB amount (S12) will now be explained in detail.

First, a speed detecting unit mounted in a motor of the washing machine is used to measure the motor rotation speed (RPM) of the washing machine over a certain period, thereby detecting the change in the RPMs of the washing machine.

Based upon the RPMs detected, a maximum change in RPMs and a minimum change in RPMs are used to detect an UB amount and a load amount.

The UB amount detected by employing the method is compared to a reference UB amount corresponding to a preset load amount. According to the comparison, when the UB amount detected is greater than the reference UB amount, the motor of the washing machine is stopped to change a rotational direction of the motor. The laundry balancing function is re-performed accordingly.

If the UB amount detected is less than the reference UB amount according to the comparison, the RPM of the washing machine is increased so as to not be over a resonant speed to perform a spinning operation in order to remove water contained in the laundry. Thereafter, the RPM of the washing machine is decreased thus to re-detect an UB amount.

When the UB amount re-detected is less than the reference UB amount, the spin cycle is performed by re-increasing the RPM. Then, within a certain time after the RPM of the washing machine reaches a preset spinning speed, the RPM of the washing machine is decreased again to re-detect a UB amount. When the UB amount re-detected is greater than the reference UB amount, the motor of the washing machine is stopped to change the rotational direction of the motor, thereby re-performing the laundry balancing function.

When the UB amount re-detected is less than the reference UB amount, the current RPM of the washing machine is increased so as to reach a preset spinning speed. The spin cycle is then performed for a preset amount of time by the preset spinning speed to thereafter terminate the spin cycle.

Regarding the related art spin cycle controlling method aforementioned, for performing the laundry balancing process, as illustrated in FIG. 2, in order to evenly distribute the laundry in the washing tub, a UB amount is checked at a certain speed (i.e., RPM). Then, only when the UB amount checked is less than a preset reference UB amount, the RPM is increased.

One disadvantage of this method is that it takes 20 to 40 minutes to determine the adequacy of the UB amount. Also, when an UB amount greater than a certain amount is generated while increasing the RPM of the washing machine, the motor of the washing machine is stopped, and thereafter the laundry balancing process of the washing machine is re-performed or the rotational direction of the motor is changed. Accordingly, the time for balancing the laundry is longer, which makes the time for the entire washing cycle longer.

SUMMARY OF THE INVENTION

Accordingly, the present invention is directed to a dehydration controlling apparatus for washing machine and method thereof that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a spin cycle controlling apparatus for a washing machine includes a storage unit in which an acceleration rate, an allowable maximum unbalance amount and an allowable minimum unbalance amount according to an amount of laundry are pre-stored; and a controlling unit for repeatedly controlling an operation of increasing and decreasing revolutions per minute (RPM) in a region between the allowable maximum unbalance amount and the allowable minimum unbalance amount until an unbalance amount detected is less than the allowable minimum unbalance amount.

In another aspect of the present invention, a spin cycle controlling method for a washing machine includes setting a region separately having an allowable maximum unbalance amount and an allowable minimum unbalance amount; and detecting an unbalance amount by increasing or decreasing revolutions per minute (RPM) of the washing machine within the set region during a spin cycle that is repeatedly performed until the unbalance amount detected is less than the allowable minimum unbalance amount.

In another aspect of the present invention, spin cycle controlling method for a washing machine includes setting a region separately having an allowable maximum unbalance amount and an allowable minimum unbalance amount; increasing revolutions per minute (RPM) of the washing machine to detect a first unbalance amount at a first target speed, and increasing the RPM by a certain acceleration to detect a second unbalance amount when the first unbalance amount is less than a first reference unbalance amount; comparing the second unbalance amount to the allowable maximum unbalance amount and the allowable minimum unbalance amount, and, increasing or decreasing the RPM, according to the comparison, until the second unbalance amount is less than the allowable minimum unbalance amount; and increasing the RPM up to a second target speed when the second unbalance amount is less than the allowable minimum unbalance amount within a certain time, and thereafter comparing a third unbalance amount detected at the second target speed to a second reference unbalance amount, to accordingly determine whether to further increase the RPM of the washing machine.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Hereinafter, with reference to the accompanying drawings, explanation will be given of a spin cycle controlling apparatus for a washing machine and a method thereof capable of decreasing spin cycle initiating time and reducing noise and vibration by applying a more precise reference acceleration amount in a clothes centrifugally-distributing region by increasing/decreasing a revolutions per minute (RPM) of a washing machine to allow a UB amount detected at a current RPM of the washing machine to be within a region having allowable UB amounts under a condition that a region between the allowable UB amounts has separately been set in an area including both the clothes centrifugally-distributing and clothes tumbling regions, before the RPM reaches a speed for initiating an UB amount determination.

Figure 1:
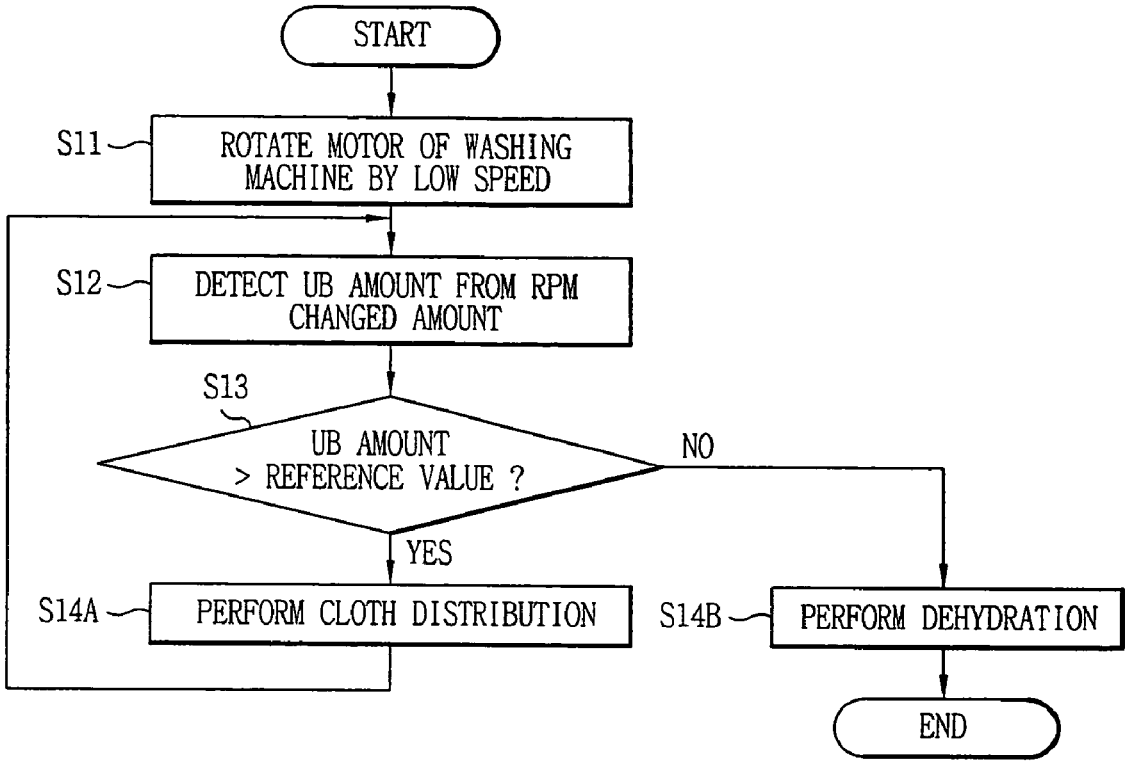
FIG. 1 is a flowchart illustrating operations related to a UB amount detecting and spinning method of a washing machine according to the related art.
Figure 2:
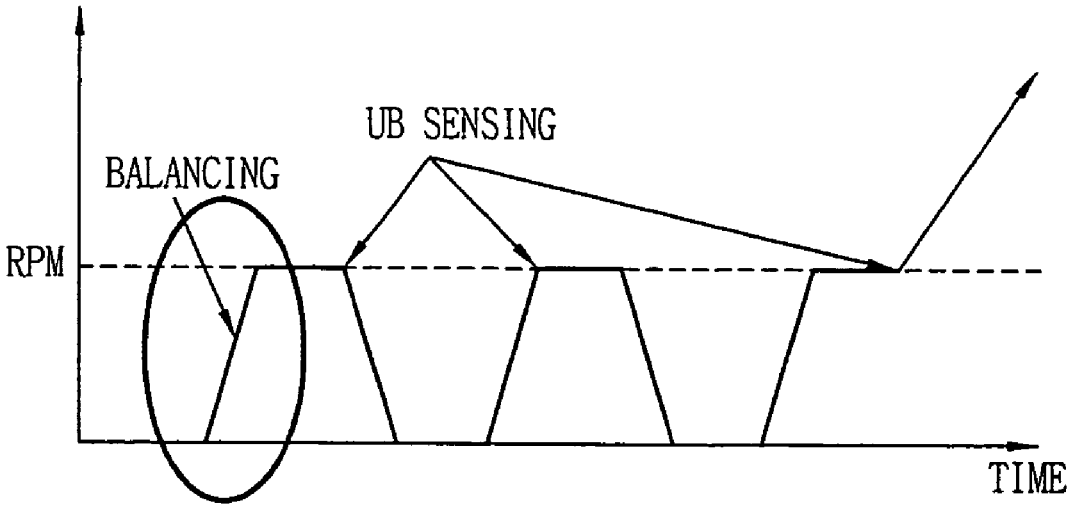
FIG. 2 is a graph illustrating a spinning process of a washing machine according to the related art.
Figure 3:
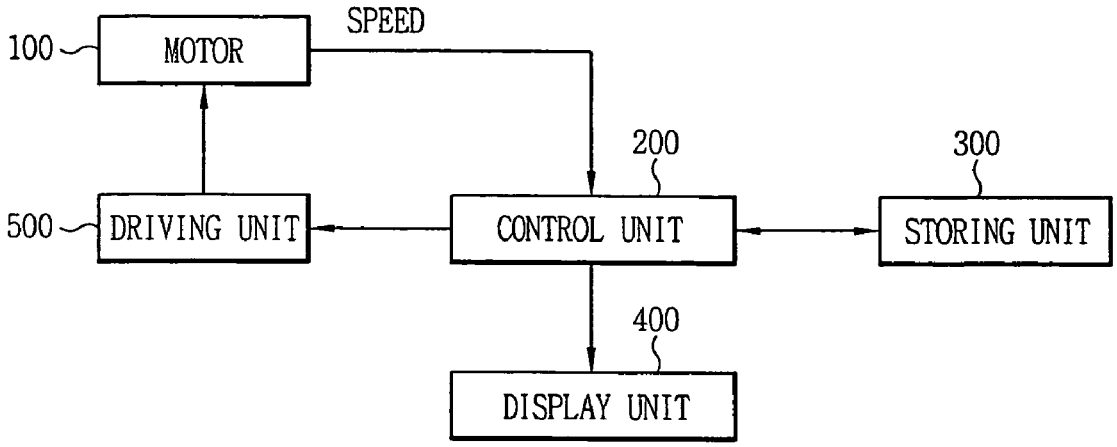
FIG. 3 is a block diagram illustrating a construction of a spin cycle controlling apparatus for a washing machine in accordance with an embodiment of the present invention.

FIG. 3 is a block diagram illustrating a spin cycle controlling apparatus for a washing machine in accordance with an embodiment of the present invention.

As illustrated in FIG. 3, a spin cycle controlling apparatus for a washing machine according to the present invention is provided with a motor 100, a driving unit 500, a storage unit 300, a display unit 400 and a controlling unit 200.

The motor 100 rotates a washing tub within the washing machine.

The driving unit 500 drives the motor 100.

The storage unit 400 pre-stores an optimal acceleration rate, an allowable maximum UB amount and an allowable minimum UB amount verses the amount of laundry.

The controlling unit 200 provides overall control for washing operations.

The controlling unit 200, according to the present invention, repeatedly controls an operation of increasing and decreasing a Rotation Per Minute (RPM) in a region between the allowable maximum UB amount and the allowable minimum UB amount until the detected UB amount is less than the allowable minimum UB amount.

Figure 4:
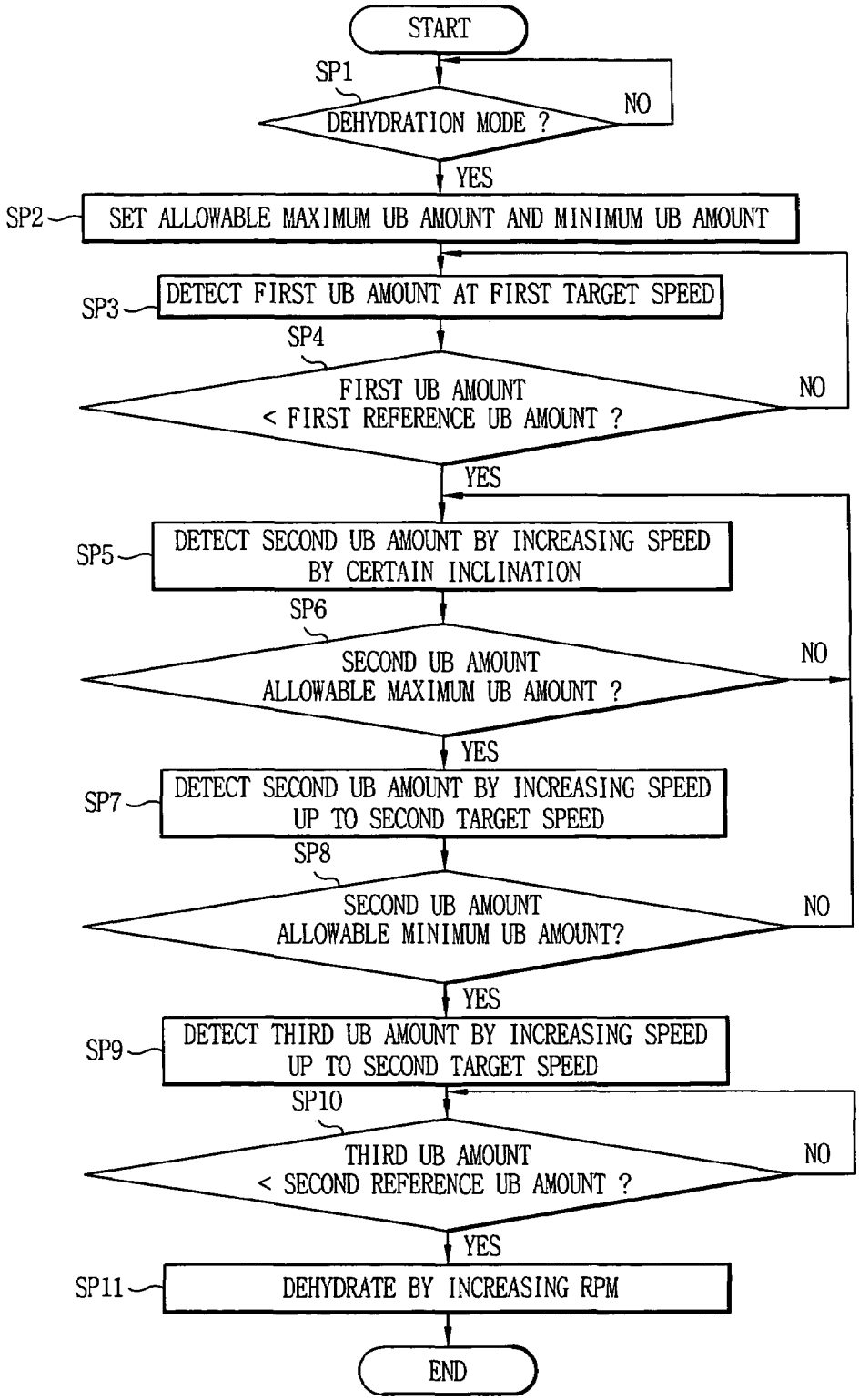
FIG. 4 is a flowchart illustrating a spin cycle controlling method for a washing machine in accordance with an embodiment of the present invention.

The present invention will now be explained in more detail with reference to FIG. 4.

First, the storage unit 300 pre-stores an optimal acceleration rate, an allowable maximum UB amount and an allowable minimum UB amount verses the amount of laundry, all of which are obtained by an experiment.

The storage unit 300 may be a Read-Only Memory (ROM) table including a database of the acceleration, the allowable maximum UB amount and the allowable minimum UB amount verses the amount of the laundry.

The controlling unit 200 sets the acceleration rate, the allowable maximum UB amount and the allowable minimum UB amount corresponding to the amount of the laundry by selecting them from the storage unit 300 (SP1 and SP2).

Next, after increasing a speed of the motor 100 of the washing machine up to a first target speed, the controlling unit 200 detects a first UB amount at the first target speed (SP3), and compares the first UB amount detected to a first reference UB amount (SP4).

When the first UB amount is less than the first reference UB amount, the controlling unit 200 increases the RPM by a certain acceleration to detect a second UB amount (SP5), and thereafter compares the second UB amount detected to the allowable maximum UB amount and the allowable minimum UB amount (SP6).

Until the second UB amount is less than the allowable minimum UB amount according to the comparison, the controlling unit 200 repeatedly performs the operation of increasing or decreasing the RPM of the washing machine (SP7 and SP8).

Figure 5:
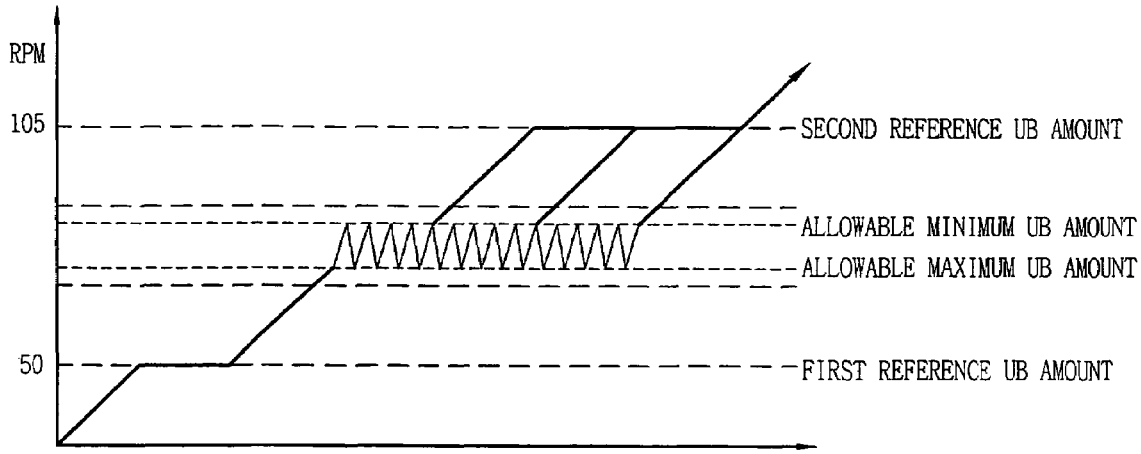
FIG. 5 is a graph illustrating a spinning process of a washing machine according to the present invention.

That is, as shown in the graph of FIG. 5, when the second UB amount which has been detected by increasing the RPM of the washing machine is less than the allowable maximum UB amount, the controlling unit 200 decreases the RPM of the washing machine by a certain acceleration to detect the second UB amount (SP7). When the second UB amount is greater than the allowable minimum UB amount (SP8), the controlling unit 200 re-increases the RPM by the certain acceleration to detect the second UB amount (SP5). Such operations are repeatedly performed until the second UB amount is less than the allowable minimum UB amount.

That is, regarding the related art spin cycle controlling method, an UB amount is checked at a certain speed by balancing the laundry in the washing tub. Accordingly, the RPM is increased only when the UB amount checked is less than a preset reference UB amount.

In other words, in the related art, it takes 20 to 40 minutes to perform the laundry balancing operation, which includes detecting the UB amount by increasing the RPM of the washing machine and then comparing the UB amount detected to the preset reference UB amount. Accordingly, the entire time for performing the washing cycle increases.

On the other hand, regarding the present invention, before the RPM reaches the speed for determining the UB amount, a region separately having allowable UB amounts is identified where the clothes both centrifugally are distributed and tumble. The operation of increasing or decreasing the RPM of the washing machine is then repeatedly performed to detect the UB amount within the region of the allowable UB amounts, and accordingly a more precise reference UB amount can be applied to the clothes in the centrifugally-distributing region.

That is, in the present invention, the UB amount is re-detected within the clothes centrifugally-distributing/clothes tumbling combined region before the RPM reaches the speed for initiating the UB amount determination. Hence, it is advantageous to reduce the time taken by reverting to the spinning speed of the washing machine for the UB amount determination as compared to the related art.

Next, when the second UB amount is less than the allowable minimum UB amount, the controlling unit 200 increases the RPM of the washing machine up to a second target speed to detect a third UB amount (SP9). The controlling unit 200 then compares the third UB amount detected at the second target speed to a second reference UB amount. The controlling unit 200 then determines whether to further increase the RPM according to the comparison (SP10).

When the third UB amount detected by increasing the RPM up to the second target speed is less than the second reference UB amount, the controlling unit 200 increases the RPM of the washing machine to thereby perform the spin cycle (SP11).

The present invention can be characterized such that before the RPM reaches the speed for initiating the UB amount determination, in the state of having set the region having the separate allowable UB amounts in the area including both the clothes centrifugally-distributing region and the clothes tumbling region, the RPM is increased or decreased to thus position the UB amount detected at the current RPM of the washing machine within the region between the allowable UB amounts, so as to employ a more precise reference UB amount in the clothes centrifugally-distributing region.

As described above, in the present invention, the dehydration controlling apparatus for a washing machine and a method thereof are capable of shortening a dehydration initiating time and reducing noise and vibration by applying the more precise reference UB amount in a clothes centrifugally-distributing region by increasing/decreasing the RPM of the washing machine to allow the UB amount detected at a current RPM of the washing machine to be within the region between the allowable UB amounts under the condition that the region between the allowable UB amounts has separately been set in the area including both the clothes centrifugally-distributing and clothes tumbling regions, before the RPM reaches a speed for initiating an UB amount determination.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A spin cycle controlling apparatus for a washing machine comprising:

a motor for rotating a washing tub within the washing machine;

a driving unit for driving the motor;

a storage unit in which an acceleration rate, an allowable maximum unbalance amount and an allowable minimum unbalance amount according to an amount of laundry are pre-stored, wherein the region between the allowable maximum unbalance amount and the allowable minimum unbalance amount is set between a clothes centrifugally-distributing region and a clothes tumbling region for evenly distributing clothes or laundry; and a controlling unit for repeatedly controlling an operation of increasing and decreasing a Rotation Per Minute (RPM) in a region between the allowable maximum unbalance amount and the allowable minimum unbalance amount until an unbalance amount detected is less than the allowable minimum unbalance amount.

2. The apparatus of claim 1, wherein the region between the allowable maximum unbalance amount and the allowable minimum unbalance amount is variably applied according to the amount of the laundry when increasing and decreasing the RPM.

3. The apparatus of claim 1, wherein the region between the allowable maximum unbalance amount and the allowable minimum unbalance amount has a separate acceleration rate.

4. The apparatus of claim 1, wherein when the unbalance amount detected is less than the allowable minimum unbalance amount, the controlling unit increases the RPM of the washing machine and then applies a separate reference unbalance amount thus to perform the spin cycle.

5. The apparatus of claim 1, wherein the controlling unit increases the RPM of the washing machine to detect a first unbalance amount at a first target speed, and increases the RPM by a certain acceleration to detect a second unbalance amount when the first unbalance amount is less than a first reference unbalance amount.

6. The apparatus of claim 1, wherein the controlling unit repeatedly increases or decreases the RPM until the second unbalance amount is less than the allowable minimum unbalance amount.

7. The apparatus of claim 6, wherein the controlling unit increases the RPM of the washing machine by a separate acceleration rate preset according the amount of the laundry.

8. The apparatus of claim 1, wherein the controlling unit increases the RPM up to a second target speed when the second unbalance amount becomes less than the allowable minimum unbalance amount within a certain time, wherein when a third unbalance amount detected at the second target speed becomes less than a second reference unbalance amount, the controlling unit then increases the RPM of the washing machine to thus perform a spin cycle.

9. A spin cycle controlling method for a washing machine comprising:

setting a region separately having an allowable maximum unbalance amount and an allowable minimum unbalance amount, wherein the region between the allowable maximum unbalance amount and the allowable minimum unbalance amount is set between a clothes centrifugally-distributing region and a clothes tumbling region for evenly distributing clothes or laundry; and detecting an unbalance amount by increasing or decreasing a Rotation Per Minute (RPM) of the washing machine within the set region during a dehydration mode activated, which is repeatedly performed until the unbalance amount detected is less than the allowable minimum unbalance amount.

10. The method of claim 9, wherein the allowable maximum unbalance amount and the allowable minimum unbalance amount are variably applied according to the amount of the laundry when increasing and decreasing the RPM.

11. The method of claim 9, wherein the region between the allowable maximum unbalance amount and the allowable minimum unbalance amount separately has an acceleration rate.

12. The method of claim 9, further comprising increasing the RPM of the washing machine when the unbalance amount detected is less than the allowable minimum unbalance amount and employing a separate reference unbalance amount to perform the spin cycle.

13. A spin cycle controlling method for a washing machine comprising:

setting a region separately having an allowable maximum unbalance amount and an allowable minimum unbalance amount, wherein the region between the allowable maximum unbalance amount and the allowable minimum unbalance amount is set between a clothes centrifugally-distributing region and a clothes tumbling region for evenly distributing clothes or laundry;

increasing a Rotation Per Minute (RPM) of the washing machine to detect a first unbalance amount at a first target speed, and increasing the RPM by a certain inclination to detect a second unbalance amount when the first unbalance amount is less than a first reference unbalance amount;

comparing the second unbalance amount to the allowable maximum unbalance amount and the allowable minimum unbalance amount, and, increasing or decreasing the RPM, according to the comparison, until the second unbalance amount is less than the allowable minimum unbalance amount; and increasing the RPM up to a second target speed when the second unbalance amount is less than the allowable minimum unbalance amount within a certain time, and thereafter comparing a third unbalance amount detected at the second target speed to a second reference unbalance amount, to accordingly determine whether to further increase the RPM of the washing machine.

14. The method of claim 13, wherein the allowable maximum unbalance amount and the allowable minimum unbalance amount have different values according to the amount of the laundry.

15. The method of claim 13, wherein the increasing or decreasing of the RPM includes increasing the RPM of the washing machine by a separate acceleration rate preset according to the amount of the laundry.

16. The method of claim 13, wherein the determining whether to further increase the RPM includes increasing the RPM of the washing machine thus to perform the spin cycle when the third unbalance amount detected is less than the second reference unbalance amount.

* * * * *